United States Patent [19]

Hasegawa et al.

[11] Patent Number: 4,945,390

[45] Date of Patent: Jul. 31, 1990

[54] IMAGE-FORMING APPARATUS

[75] Inventors: Hirofumi Hasegawa; Hiroaki Kojima; Yasuhiro Matsuura; Naoto Ohmori; Yukio Yamada, all of Osaka, Japan

[73] Assignee: Minolta Camera Kabushiki Kaisha, Osaka, Japan

[21] Appl. No.: 357,021

[22] Filed: May 25, 1989

[30] Foreign Application Priority Data

Jun. 1, 1988 [JP] Japan ..... 63-136278

[51] Int. Cl.[5] ..... G03G 15/00

[52] U.S. Cl. ..... 355/321; 355/318; 355/319; 271/3.1; 271/301; 271/303

[58] Field of Search ..... 355/309, 313, 316, 317, 355/318, 319, 320, 321, 322; 271/3.1, 301, 302, 303

[56] References Cited

U.S. PATENT DOCUMENTS 3,702,697 11/1972 Leutwein et al. ..... 271/3.1
4,453,819 6/1984 Wada et al. ..... 355/321 X
4,466,733 8/1984 Pels ..... 355/321 X
4,667,951 5/1987 Honjo et al. ..... 271/3.1
4,708,462 11/1987 Stemmle ..... 355/319 X
4,730,206 3/1988 Sanada et al. ..... 355/309
4,750,016 6/1988 Kusumoto et al. ..... 355/318 X
4,814,825 3/1989 Johdai et al. ..... 355/14 SH

*Primary Examiner*—A. C. Prescott
*Attorney, Agent, or Firm*—Willian Brinks Olds Hofer Gilson & Lione

[57] ABSTRACT

An image-forming apparatus comprises a machine body and a paper discharge unit removably attached to the machine body. The machine body defines a face-down discharge tray on top. The paper discharge unit includes a face-up discharge tray and a discharge roller pair. A switch lever is provided in the machine body for selecting between a state in which recording paper is turned over for discharge onto the face-down discharge tray, and a second state in which the recording paper is discharged face up onto the face-up discharge tray.

6 Claims, 3 Drawing Sheets

IMAGE-FORMING APPARATUS

BACKGROUND OF THE INVENTION (1) Field of the Invention

The present invention relates to image-forming apparatus such as copying machines and laser beam printers having constructions similar to the copying machines which, after forming an image on recording paper inside their machine body, are capable of selective discharge of the recording paper, either face down, i.e. with an image-carrying side down, or face up, i.e. with the image-carrying side up.

(2) Description of the Prior Art

Some image-forming apparatus for forming images on recording paper in response to image information, such as laser beam printers, copying machines, facsimile equipment, and printing machines, are constructed to selectively discharge the recording paper face down or face up for convenience of the operator in recording operations.

FIG. 4 shows, in sectional front view, an outline of one such image-forming apparatus known in the art, which is a laser beam printer 50 here.

The illustrated laser beam printer 50 comprises a machine body 60 housing a photoreceptor drum 61 rotatable clockwise in a substantially central position thereof. The drum 61 is surrounded by a main charger 62, a developer 63, a transfer charger 64 and a cleaning device 65.

The drum 61 is exposed by a laser beam modulated by an image signal and deflected by a polygonal mirror 66.

A paper feed tray 67 is mounted to the righthand side of the machine body 60. A feed roller 68 takes recording paper P sheet by sheet from the tray 67, and feeds the paper P to a transport passage including a timing roller pair 69, a conveyer belt 70 and fixing rollers 71. While advancing through this passage, the recording paper P receives an image from the drum 61 and has the image fixed thereto by the fixing rollers 71.

The paper P carrying the image fixed thereto is discharged either through a face-down discharge passage to a face-down tray 76 provided on top of the machine body 60 or through a face-up discharge passage to a face-up tray 77 removably attached to the machine body 60. As seen, the face-down discharge passage extends from the fixing rollers 71 through a guide 80, passage walls 74 and a face-down discharge roller pair 72. The face-up discharge passage extends from the fixing rollers 71 through the guide 80 and a face-up discharge roller pair 73.

The guide 80, face-down discharge roller pair 72, passage walls 74 and face-up discharge roller pair 73 constituting the discharge passages are all disposed inside the machine body 60. The guide 80 is pivotable by operating a lever not shown, for selecting between the two discharge passages.

FIG. 4 shows a state in which the face-down discharge passage is selected. In this state, the recording paper P carrying an image formed on an upper side thereof is turned over while passing through the passage walls 74, and discharged with the image-carrying side facing down.

The face-down discharge results in the sheets of recording paper P arranged in the order of image formation. This advantageously dispenses with an operation for rearranging the sheets, i.e. putting the sheets in the order of page numbering, after the image-forming operation.

For this reason, the face-down discharge is used in most cases with printers such as the laser beam printer 50 which discharges sheets one page after another.

On the other hand, the face-up discharge with the face-up tray 77 attached to the machine body 6 enables the operator to look at the image immediately upon discharge of the recording paper P. This has the advantage of allowing the image-forming operation to be carried out while confirming the formed image. Compared with the face-down discharge, the face-up discharge has the further advantage of paper transport reliability with little chance of paper jamming since its passage extends substantially straight and does not include a curve such as defined by the passage walls 74. Thus, the face-up discharge is selected particularly when using thick paper such as envelopes.

In order to meet various operational requirements or user needs, the known image-forming apparatus, or the laser beam printer in this case, has the machine body 60 containing all of the guide 80 for selecting between the face-down and face-up discharge passages, the face-down discharge roller pair 72, passage walls 74 and face-up discharge roller pair 73 as noted above. The user has only to attach the face-up tray 77 for selecting either the face-down discharge or face-up discharge.

However, the face-up discharge roller pair 73 and face-up tray 77 are altogether unnecessary to the user who selects the face-down discharge in his or her day-to-day operations. Although the face-up tray 77 may be removed from the machine body 60, the face-up discharge roller pair 73 mounted in the machine body 60 is inseparable therefrom.

The machine body 60, which is the larger for containing the face-up discharge roller pair 73 used rarely, allows a reduced working space for the user. There is also a disadvantage of the machine body 60 being costly with the inclusion of the face-up discharge roller pair 73.

SUMMARY OF THE INVENTION

The object of the present invention is to provide an image-forming apparatus such as a laser beam printer or a copying machine having a compact machine body, which eliminates the disadvantage of the prior art noted above and is capable of both the face-down and face-up discharges.

The above object is fulfilled, according to the present invention, by an image-forming apparatus comprising a machine body including image-forming means for forming an image on one side of recording paper, a first tray, a first transport passage means for discharging the recording paper with the image-carrying side facing down onto the first tray, and a second transport passage means branched from the first transport passage means; and a paper discharge unit removably attached to the machine body and including a second tray, and discharge roller means for discharging the recording paper delivered through the second transport passage means with the image-carrying side facing up onto the second tray.

In the above construction, the discharge rollers needed for discharging the recording paper face up are included in the second tray, namely a face-up tray, removably attached to the machine body. As a result, the entire apparatus is reduced in size and cost.

The foregoing and other objects, features and advantages of the invention will be apparent from the following more particular description of a preferred embodiment of the invention, as illustrated in the accompanying drawings.

DETAILED DESCRIPTION OF THE PREFERRED EMBODIMENT

An embodiment of the present invention will be described hereinafter with reference to FIGS. 1 through 3.

Figure 1:
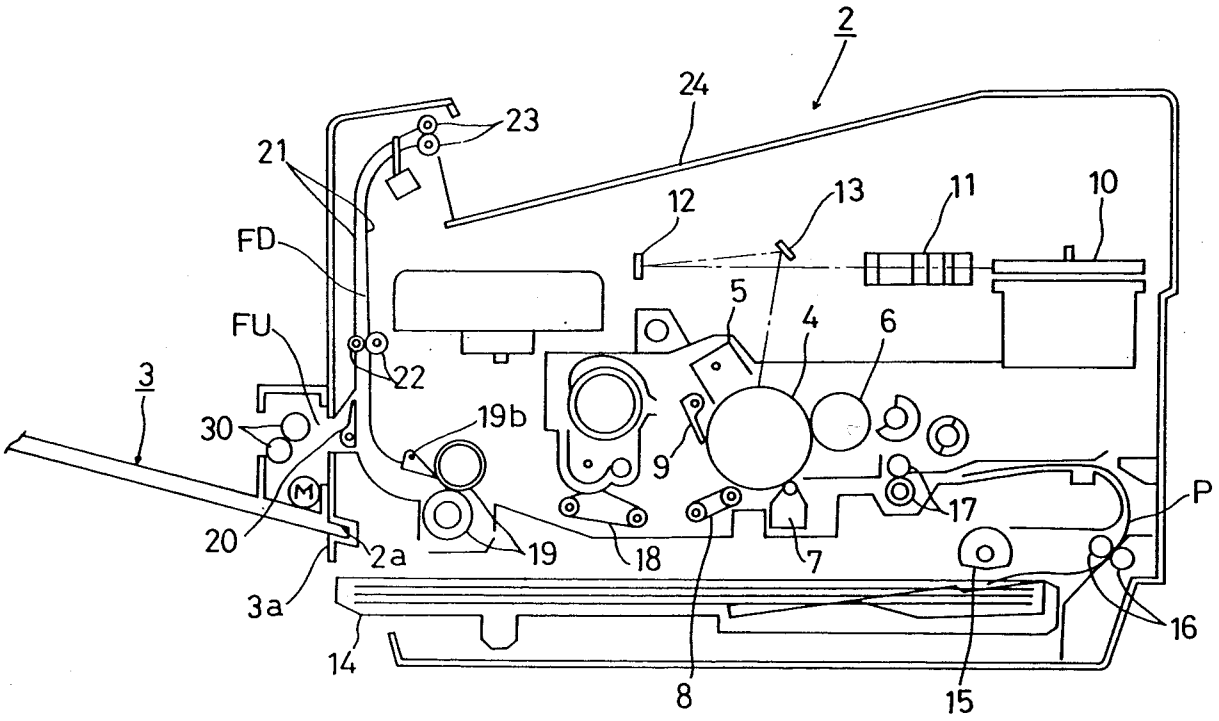
FIG. 1 is a sectional front view showing an outline of a laser beam printer according to the present invention.

FIG. 1 is a sectional front view schematically showing a laser beam printer as one example of image-forming apparatus.

The laser beam printer 1 comprises a machine body 2, and a face-up tray 3 offered as an option for removably attaching to the machine body 2. As described later, the machine body 2 includes a mechanism for carrying out face-down discharge as a standard mode. Face-up discharge is possible when the face-up tray 3 is attached to the machine body 2.

The machine body 2 houses a photoreceptor drum 4 rotatable clockwise in an approximately central position thereof. The drum 4 is surrounded by a main charger 5, a developer 6, a transfer charger 7, a separator belt 8 for separating recording paper from the drum 4, and a blade type cleaning device 9 for collecting excess toner after image transfer.

The drum 4 has a photosensitive layer formed on its surface which is uniformly charged when opposed to the main charger 5, and is exposed by a laser beam deflected by a polygonal mirror 10. The laser beam modulated by a signal corresponding to image information travels through an f-theta lens 11, which provides a constant scanning speed, and mirrors 12 and 13 to impinge upon the photosensitive layer, thereby forming a latent image thereon.

The machine body 2 further includes a paper feed tray 14 mounted in a lower position thereof for supporting cut sheets of recording paper P. The paper feed roller 15 of half-moon shape takes the recording paper P sheet by sheet from the paper feed tray 14 and feeds it to a transport passage including a transport roller pair 16, a timing roller pair 17, a conveyer belt 18 and a fixing roller pair 19. While advancing through the transport passage, the recording paper P receives the image from the photoreceptor drum 4 and the image is fixed to the recording paper P by the heated fixing roller pair 19.

The recording paper P with the image fixed thereto is separated from the fixing roller pair 19 by a separator blade 19*b*. The paper P is then discharged either through a face-down discharge passage FD to a face-down tray 24 integrally provided on top of the machine body 2 or through a face-up discharge passage FU to the face-up tray 3 attached to the machine body 2. The face-up tray 3 is attached to the machine body 2 with a projection 3*a* inserted into a recess 2*a* defined in a lateral wall of the machine body 2. The face-down discharge passage FD extends from the fixing roller pair 19 through a guide 20 acting as switching means, passage walls 21 arranged along the lateral side of the machine body 2, and face-down discharge roller pairs 22 and 23. The face-up discharge passage FU extends from the fixing rollers 19 through the guide 20 and a face-up discharge roller pair 30 included in the face-up tray 3.

The passage walls 21 are curved at an upper position thereof inwardly of the machine body 2. Thus the recording paper P passing through the face-down discharge passage FD is turned over for the face-down discharge.

Figure 2:
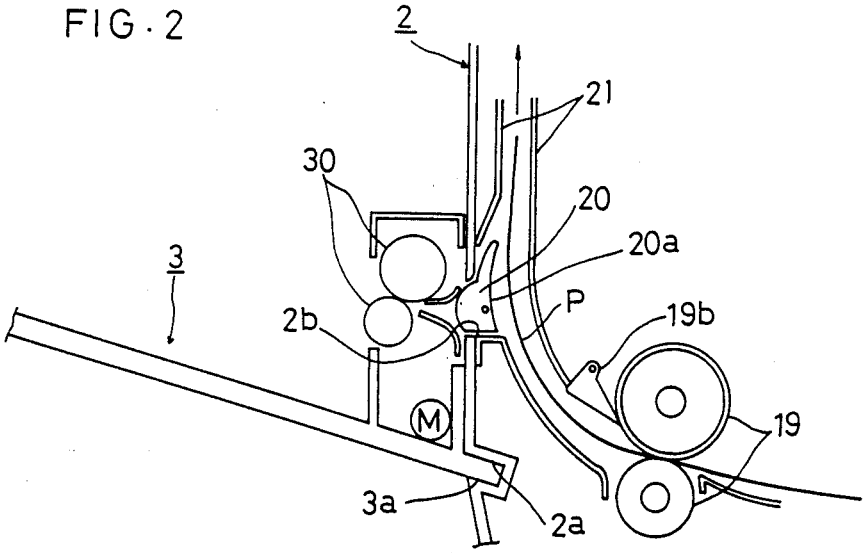
FIGS. 2 and 3 are enlarged partial sections of the laser beam printer of FIG. 1, respectively.
Figure 3:
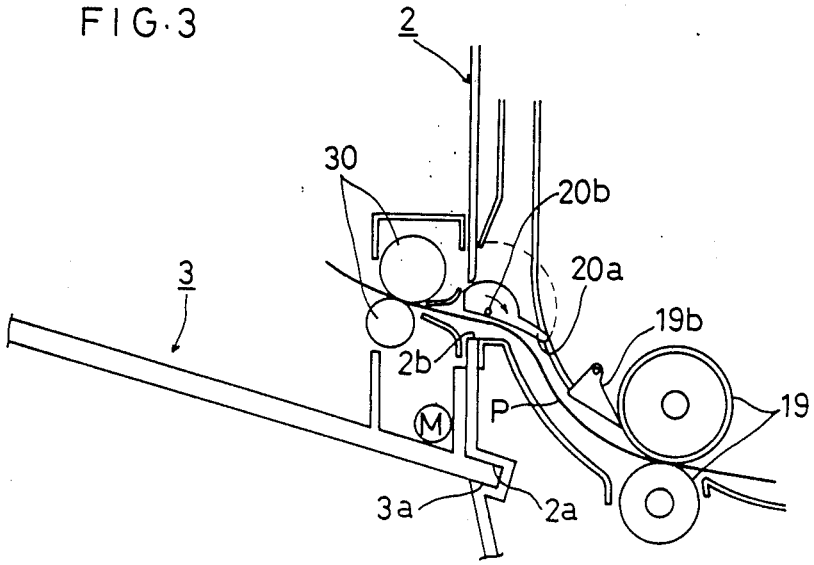
Figure 4:
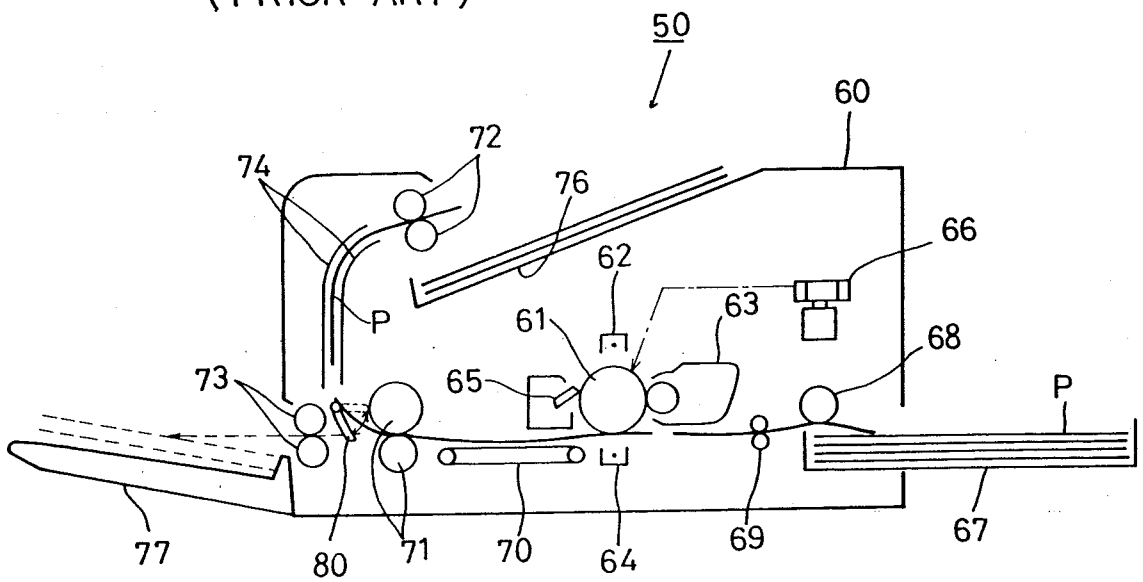
FIG. 4 (PRIOR ART)
FIG. 4 is a sectional front view showing an outline of a known laser beam printer.

FIGS. 2 and 3 are enlarged partial views in section of the laser beam printer 1. The switching action of the guide 20 will be described with reference to these drawings.

In FIG. 2 the face-down discharge is selected in which the guide 20 disposed adjacent a lateral opening 2*b* of the machine body 2 has a guide surface 20*a* thereof held substantially parallel to the passage walls 21.

In this state, the recording paper P emerging from the fixing roller pair 19 is guided by the guide surface 20*a* to the face-down roller pairs 22 and 23. The face-up tray 3 is not needed at this time, and may be removed from the machine body 2.

In FIG. 3, the guide 20 is turned about 90 degrees clockwise on an axis 20*b* by operating a manual control lever (not shown) provided on the machine body 2, with the guide surface 20*a* now extending substantially horizontally.

In this state, the face-up discharge is selected and the recording paper P emerging from the fixing roller pair 19 is guided by the guide surface 20*a* outwardly of the machine body 2 through the lateral opening 2*b*. The paper P exiting the machine body 2 is discharged onto the face-up tray 3 by the face-up discharge roller pair 30 provided on the face-up tray 3 in an opposed relationship with the lateral opening 2*b* of the machine body 2.

The face-up discharge roller pair 30 is driven by a motor M included in the face-up tray 3. This motor receives power from the machine body 2 through connectors (not shown) disposed at the projection 3*a* and the lateral recess 2*a*, and is operable in an interlocked relationship with the image-forming operation of the machine body 2.

In the above embodiment, the guide 20 is disposed at a position to close the lateral opening 2*b* of the machine body 2. There is thus no chance of the operator inserting his or her fingers into the opening 2*b* and inadvertently have them scorched by touching the hot fixing roller pair 19 when the face-up tray 3 is removed. The guide 20 is switchable to open the lateral opening 2*b* when the face-up tray 3 is attached. However, the presence of the face-up discharge roller pair 30 prevents such an accident resulting from insertion of fingers.

In the foregoing embodiment, the guide 20 is switchable by the manual control lever provided on the machine body 2. This lever may be provided on the face-up tray 3 instead. Further, the guide 20 may be switchable electrically rather than mechanically.

In the foregoing embodiment, the guide 20 is turned with the face-up tray 3 already attached to the machine body 2. Instead, turning of the guide 20 may automatically accompany attachment and detachment of the face-up tray 3.

Further, in the foregoing embodiment, the guide 20 is movably mounted in the machine body 2. Instead, the face-up tray 3 may include a guide fixed thereto, which extends into the face-down discharge passage to form the face-up discharge passage when the face-up tray 3 is attached to the machine body 2. It is necessary in this case to provide a movable passage wall in a position of the machine body 2 to which the face-up tray is attached, for closing the face-down discharge passage when the face-up tray is removed.

The described embodiment may employ various fitting or engaging devices or bolts and pins for removably attaching the face-up tray 3 to the machine body 2.

Cut sheets of the recording paper P used in the described embodiment may of course be replaced with a continuous sheet of paper such as roller paper.

In the described embodiment, the passage walls 21 define the face-down discharge passage FD. Where the image-forming apparatus has such a transport passage that requires recording paper to be reversed for the face-up discharge, similar passage walls and discharged rollers may be provided in the face-up tray for defining a face-up discharge passage.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image-forming apparatus comprising:

a machine body including image-forming means for forming an image on one side of recording paper, a first tray, a first transport passage means for discharging the recording paper with said one side facing down onto said first tray, and a second transport passage means branched from said first transport passage means; and a paper discharge unit removably attached to said machine body and including a second tray, and discharge roller means for discharging the recording paper delivered through said second transport passage means with said one side facing up onto said second tray.

2. An image-forming apparatus comprising:

a machine body including image-forming means for forming an image on an upper face of recording paper, a first tray disposed above said image-forming means, a first transport passage means having a reversing portion for reversing the recording paper once for face-down discharge onto said first tray, and a second transport passage means branched from said first transport passage means at a position upstream of said reversing portion with respect to a paper transport direction; and a paper discharge unit removably attached to said machine body and including a second tray and discharge roller means for discharging the recording paper delivered through said second transport passage means face up onto said second tray.

3. An image-forming apparatus comprising:

image-forming means for forming an image on one side of recording paper;

a first tray;

a second tray removable from said apparatus;

a first transport passage means for discharging the recording paper with said one side facing down onto said first tray;

a second transport passage means branched from said first transport passage means for transporting the recording paper toward said second tray with said one side facing up;

discharge roller means for discharging the recording paper delivered through said second transport passage means onto said second tray; and switch means for selectively providing a first state for allowing the recording paper delivered through said first transport passage means to move further on through said first transport passage means and a second state for directing the recording paper into said second transport passage means;

wherein said discharge roller means is removable with said second tray from said machine body.

4. An apparatus as claimed in claim 3, wherein said second transport passage means is also removable with said second tray from said machine body, said switch means providing said first state when said second tray is attached to said machine body and said second state when said second tray is removed from said machine body.

5. An apparatus as claimed in claim 3, wherein said switch means comprises a pivotable lever for defining a first guide surface forming part of a passage wall of said first transport passage means when in said first state, and a second guide surface forming part of a passage wall of said second transport passage means when in said second state.

6. An apparatus as claimed in claim 5, wherein said pivotable lever is manually controllable.

* * * * *

UNITED STATES PATENT AND TRADEMARK OFFICE

CERTIFICATE OF CORRECTION

PATENT NO. : 4,945,390

DATED : July 31, 1990

INVENTOR(S) : Hirofumi Hasegawa, et al.

It is certified that error appears in the above-identified patent and that said Letters Patent is hereby corrected as shown below:

In col. 5, line 11, change "roller" to --rolled--.

In col. 6, line 36 (claim 4, line 4), change "first state" to --second state--.

In col. 6, line 37 (claim 4, line 5), change "second state" to --first state--.

Signed and Sealed this

Twenty-sixth Day of November, 1991

*Attest:*

HARRY F. MANBECK, JR.

*Attesting Officer*

*Commissioner of Patents and Trademarks*